US005918918A

United States Patent [19]

Mosley

[11] Patent Number: 5,918,918

[45] Date of Patent: Jul. 6, 1999

[54] ANTI-NOISE COLLAR FOR VEHICLE LATCH

[75] Inventor: Roger Matthew Mosley, Warren, Mich.

[73] Assignee: General Motors Corporation, Detroit, Mich.

[21] Appl. No.: 08/863,271

[22] Filed: May 27, 1997

[51] Int. Cl.[6] ..... E05B 15/02

[52] U.S. Cl. ..... 292/341.12; 292/DIG. 38; 292/DIG. 55; 292/DIG. 56

[58] Field of Search ..... 292/341.11, 341.12, 292/341.13, DIG. 38, DIG. 39, DIG. 55, DIG. 56, DIG. 57

[56] References Cited

U.S. PATENT DOCUMENTS

| | | | |
|---|---|---|---|
| 3,103,378 | 9/1963 | Ahlgren . | |
| 3,610,668 | 10/1971 | Tixier | 292/341.12 |
| 4,022,504 | 5/1977 | Anderson | 292/340 |
| 5,064,229 | 11/1991 | Hamada | 292/216 |
| 5,606,771 | 3/1997 | Young | 292/341.12 |
| 5,618,069 | 4/1997 | Konchan | 292/216 |

*Primary Examiner*—Steven Meyers
*Assistant Examiner*—Gary Estremsky
*Attorney, Agent, or Firm*—Charles E. Leahy; Kathryn A. Marra

[57] ABSTRACT

A yieldable plastic collar is mounted on the latch housing to surround the entry recess of the housing and be engaged by the striker to thereby isolate the striker from noise producing contact with the housing. The plastic collar has a base portion attached to the housing and a striker contacting portion projecting from the base portion into the entry recess of the latch housing. The contacting portion is connected to the base portion by an integrally molded living hinge so that the contacting portion yields to remain in full time contacting engagement with the striker irrespective of shifting movement or misalignment between the housing and the striker. The plastic collar is attached to the latch housing at attachment points which are offset from the contacting portion of the plastic collar so that shifting movement of the striker relative to the latch housing may cause yielding and flexure of the base portion to accommodate further relative movement between the housing and the striker beyond the range of relative movement permitted by the yielding of the living hinge.

2 Claims, 4 Drawing Sheets

FIG. 1
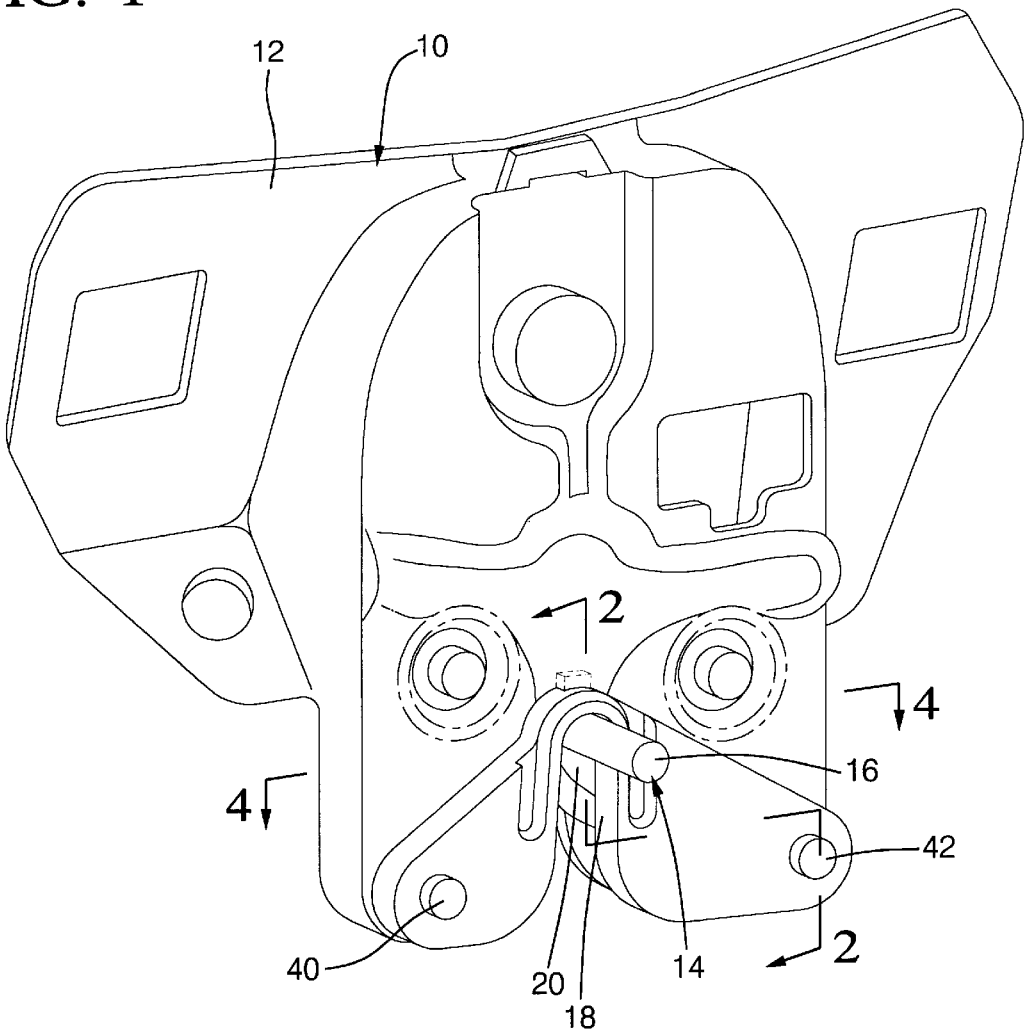
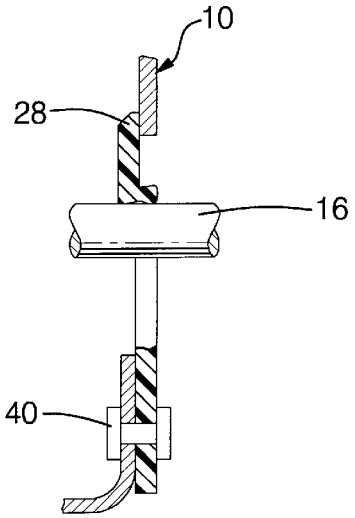
FIG. 2

ANTI-NOISE COLLAR FOR VEHICLE LATCH

TECHNICAL FIELD

This invention relates to a vehicle latch and, more particularly, provides a latch mounted collar of yieldable plastic which is yieldably engaged by the striker to maintain full time noise preventing contact with the striker.

BACKGROUND OF THE INVENTION

It is well known in vehicle luggage compartments to provide a lid which pivots between open and closed positions and is retained in the closed position by a latch which comes into engagement with the striker. The latch may be mounted on the lid and the striker on the body. Alternatively, the latch may be mounted on the body and the striker on the lid.

The latch typically includes a metallic housing having an entry recess for receiving the striker. A fork bolt is pivotally mounted on the housing for movement to engage and disengage the striker. The housing and the striker are each manufactured of metal so that noise will result upon engagement or vibration of the metal parts against one another. The prior art has recognized that a molded plastic collar may be riveted to the latch housing surrounding the entry recess and positioned at a predetermined distance from the striker to become engaged by the striker should some misalignment or relative shifting movement occur between the striker and the latch housing. Upon such misalignment on movement, the striker would engage with the plastic collar rather than with the metal of the latch housing to isolate the metal latch and metal striker from direct engagement of one another.

The present invention provides further improvements in the use of a plastic collar interposed between the latch housing and the striker.

SUMMARY OF THE INVENTION

According to the invention, a yieldable plastic collar is mounted on the latch housing to surround the entry recess of the housing and be engaged by the striker to thereby isolate the striker from noise producing contact with the housing eliminates gaps between the striker and collar. The plastic collar has a base portion attached to the housing and a striker contacting portion projecting from the base portion into the entry recess of the latch housing. The contacting portion is connected to the base portion by an integrally molded living hinge so that. The contacting portion yields to remain in full time contacting engagement with the striker irrespective of shifting movement or misalignment between the housing and the striker. The plastic collar is attached to the latch housing at attachment points which are offset from the contacting portion of the plastic collar so that shifting movement of the striker relative to the latch housing may cause yielding and flexure of the base portion to accommodate further relative movement between the housing and the striker beyond the range of relative movement permitted by the yielding of the living hinge.

BRIEF DESCRIPTION OF THE DRAWINGS

These and other objects, features and advantages of the invention will become apparent upon consideration of the Description of the Preferred Embodiment and the appended drawings in which:

FIG. 1 is a perspective view of a latch and striker according to the invention;

FIG. 2 is a section view taken in the direction of arrows 2—2 of FIG. 1;

DESCRIPTION OF THE PREFERRED EMBODIMENT

Figure 3:
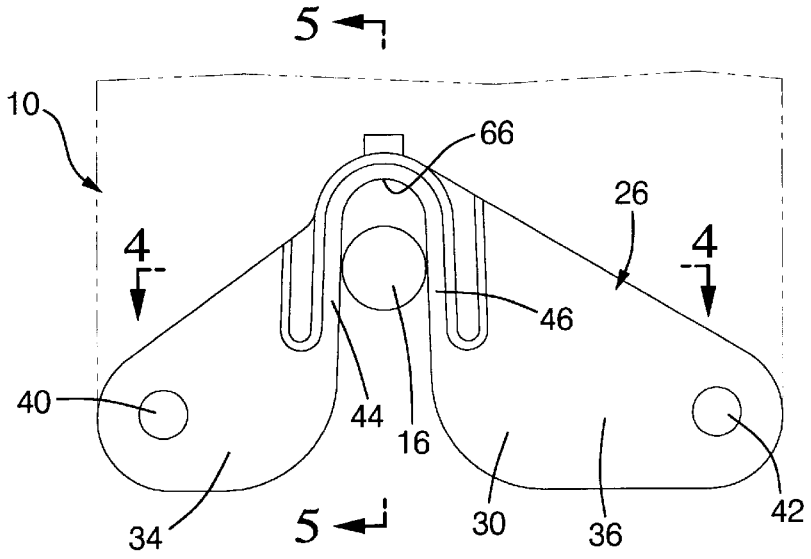
FIG. 3 is a fragmentary front elevation view similar to FIG. 1 but showing the latch just prior to full travel of the striker into the entry recess of the housing.

Referring to FIG. 1, it is seen that a vehicle latch 10 has a latch housing 12 mounted on a vehicle deck lid, not shown. A striker 14 is mounted on the vehicle body, not shown, and includes a striker rod 16 which enters into an entry recess 18 of the latch housing 12 as the deck lid is closed. The latch 10 includes a fork bolt 20 which engages with the striker rod 16 to retain the deck lid in the closed position.

Figure 6:
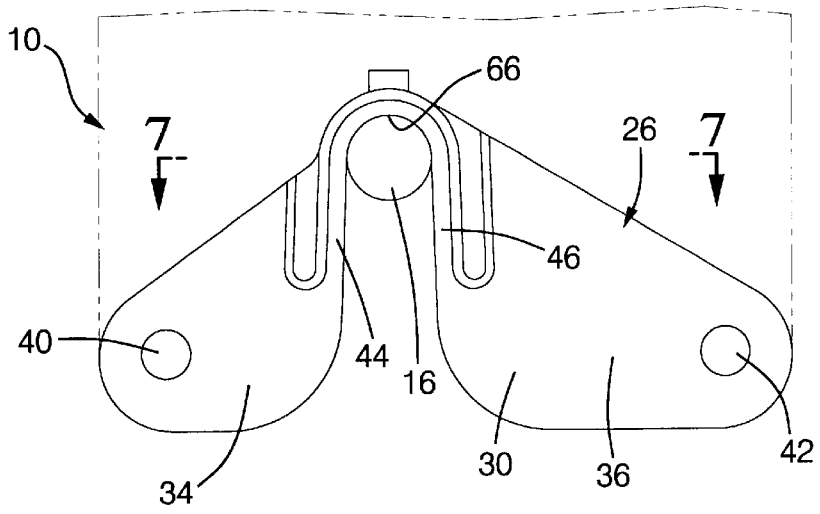
FIG. 6 is a view similar to FIG. 3, but showing the full travel of the striker into the entry recess of the latch housing.

As best seen in FIGS. 1, 2, 6 and 7 a molded plastic noise-reducing collar, generally indicated at 26, is mounted on the housing 12. The collar 26, as seen in FIG. 6, is of an inverted U-shape including a striker receiving recess 28 which is formed in a base portion 30 having a left hand mounting leg 34 and a right hand mounting leg 36. The left hand mounting leg 34 is attached to the latch housing 12 by rivet 40 and the right hand mounting leg 36 is attached to the latch housing 12 by rivet 42. The recess 28 of the collar 26 is defined by left hand contacting portion 44 and right hand contacting portion 46 which are respectively integrally connected to the mounting legs 34 and 36 by integral living hinges 48 and 50 best seen in FIG. 4. The contacting portion 44 includes the contact finger 54 and a reaction leg 56. Likewise, contacting portion 46 includes a contact finger 58 and reaction leg 60.

Figure 4:
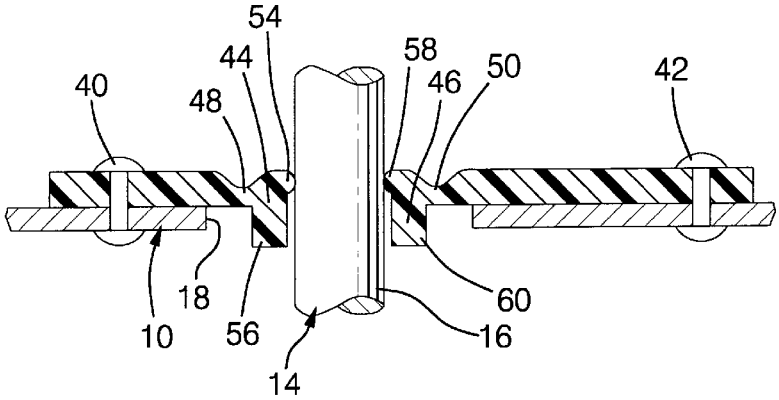
FIG. 4 is a section view taken in the direction of arrows 4—4 of FIG. 3.
Figure 5:
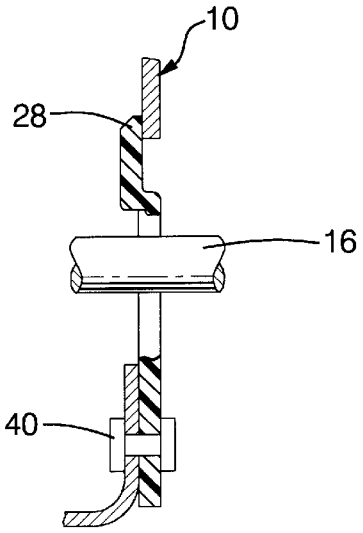
FIG. 5 is a section view taken in the direction of 5—5 of FIG. 3.

FIGS. 3, 4 and 5 show the relative position of the latch and striker as the latch 12 is lowered atop the striker 16 to initiate contact of the contact fingers 54 and 58 with the striker rod 16. As seen in FIG. 3, the contact fingers 54 and 58 converge slightly towards one another and join with an arcuate upper contact finger 66 which defines the upper margin of collar recess 28. In FIG. 3, the striker rod 16 has obtained initial contact with the contact fingers 54 and 58 but remains spaced just below the upper contact finger 66 as seen in FIG. 5, which defines the upper margin of the collar recess 28.

Figure 7:
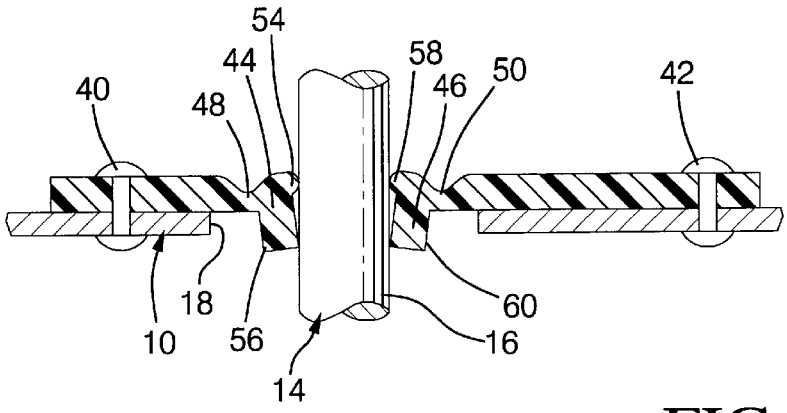
FIG. 7 is a section view taken in the direction of arrows 7—7 of FIG. 6.

Upon a further downward travel of the latch 10 from the position of FIGS. 5 and 3 and to the fully latch position of FIG. 6, the fork bolt 20 becomes latchingly engaged with the striker rod 16 to retain the deck lid in the closed position. As seen in FIG. 7, this further entry of the striker rod 16 into the housing recess 18 causes the contacting fingers 54 and 58 to pivot the contacting portions 44 and 46 to their respective positions of FIG. 7 in which the reaction legs 56 and 60 have also come into engagement with the striker rod 16.

Furthermore, as seen in FIG. 2, this further downward movement of the latch housing 12 has caused the upper contact finger 66 to be engaged and yielded by the striker rod 16. Accordingly, as seen in FIGS. 2 and 7, the yielding of the plastic collar 28 will assure reliable contact between the collar 28 and the striker pin 16 to yieldably isolate the striker pin 16 from noise-producing engagement with the housing 12.

Figure 8:
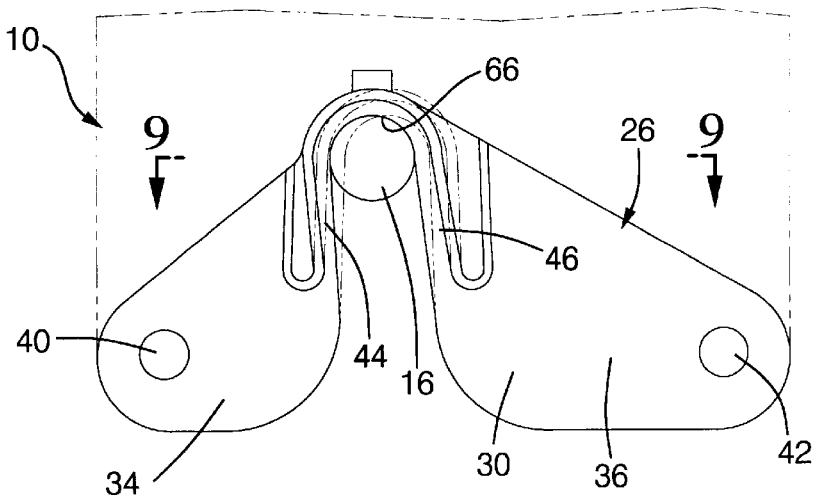
FIG. 8 is, an elevation view similar to FIGS. 3 and 6, but showing the striker having shifted leftwardly relative the latch housing so that the plastic collar is flexed laterally.
Figure 9:
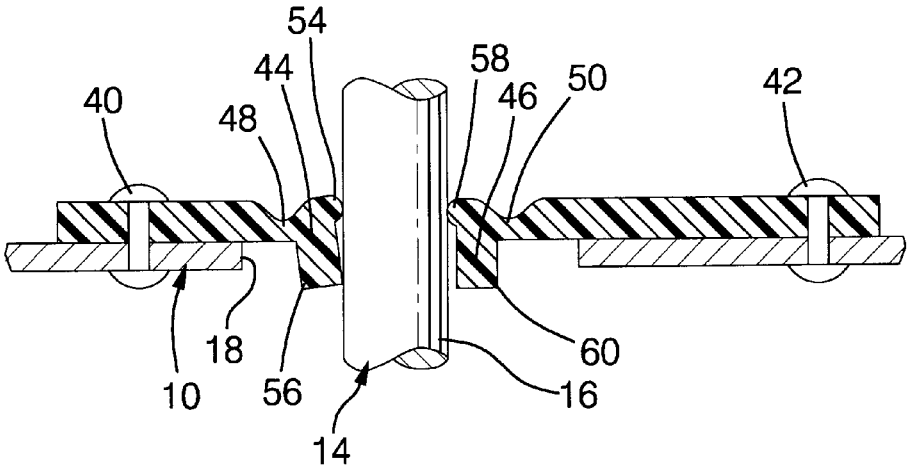
FIG. 9 is a section view taken in the direction of arrows 9—9 of FIG. 8.
Figure 10:
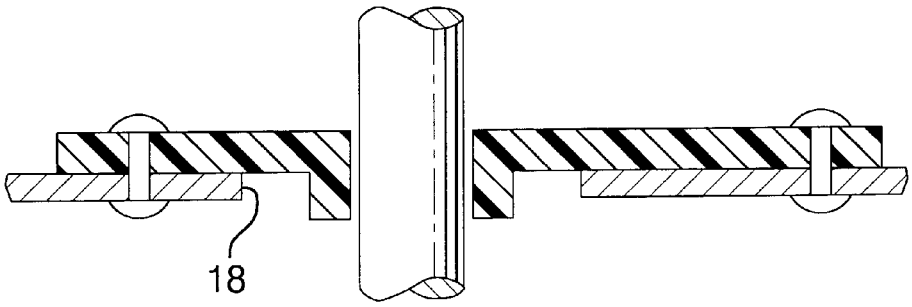
PRIOR ART FIG. 10
FIG. 10 is a view similar to FIG. 7 but showing the prior art plastic collar.

Referring to FIGS. 8 and 9, it is seen that the latch housing 12 has been shifted rightwardly somewhat, relative to the latch housing, as compared to the normal position shown in FIGS. 3 and 6. Such a condition can be caused by either a relative misalignment of the mounting positions of the latch 10 and striker 14, or by vibration or other movement of the deck lid relative to the striker 14. In either case, FIG. 8 shows the normal condition of the plastic collar 26 in phantom line and the solid lines indicate a flexed condition of the collar 26 in which the collar legs 34 and 36 have been flexed sufficient to reestablish the slot recess 28 in a more leftward position to receive the striker rod 16. FIG. 9 shows that the contacting portions 44 have been flexed and both contacting portions 44 and 46 of the plastic collar 26 remain in contact with the striker rod 16 during such lateral shifting movement of the striker pin 16 and the plastic collar 26.

It will also be understood that the plastic collar will be maintained in contact with the striker rod 16 upon occurrence of some vertical misalignment between the latch 10 and striker assembly 14, or during vertical vibration occurring in the vertical direction. In particular, as viewed in FIG. 2, an upward relative movement of the latch 10 will permit the contact finger 66 to be unflexed toward its position of FIG. 5 while an downward movement of the latch 10 will cause the plastic collar 26 to yield at arms 34 and 36.

Thus, it is seen that the invention provides a new and improved vehicle latch housing having a plastic collar surrounding the entry recess to consistently engage by the striker to thereby isolate the striker from noise-producing contact with the housing.

I claim:

1. In a vehicle latch housing having an entry recess for entry of a striker and a fork bolt pivotal on the housing to engage and disengage the striker, and a plastic collar mounted on the housing and surrounding the entry recess to be engaged by the striker and isolate the striker from noise producing contact with the housing, the improvement comprising:

said plastic collar having a generally planar base portion overlying the housing and having a striker receiving recess overlying the entry recess of the housing and left-hand and right-hand mounting legs extending on opposite sides of the striker receiving recess and attached to the housing, said collar further having a striker contacting portion connected to the base portion by an integrally molded living hinge and projecting into the striker receiving recess so that the striker contacting portion hinges as needed to remain in full-time contact engagement with the striker upon engagement of the fork bolt with the striker, irrespective of shifting movement and misalignment encountered between the housing and the striker.

2. The vehicle latch housing of claim 1 further characterized by the mounting legs of the plastic collar being attached upon the housing at a point offset from the contacting portion of the collar and the mounting legs being yieldable so that a shifting movement of the striker relative the housing may cause flexure of the base portion of the collar relative to the mounting lets to sustain the full-time contact engagement of the striker contacting portions of the collar with the striker pin to further accommodate shifting movement and misalignment between the housing and the striker.

* * * * *